US007169442B1

(12) United States Patent
O'Brien

(10) Patent No.: US 7,169,442 B1
(45) Date of Patent: Jan. 30, 2007

(54) SEAMLESS EPOXY COATING INSTALLATION METHOD

(75) Inventor: Christopher J. O'Brien, Libertyville, IL (US)

(73) Assignee: Prime Coat Corporation, Liberty Ville, IL (US)

( * ) Notice: Subject to any disclaimer, the term of this patent is extended or adjusted under 35 U.S.C. 154(b) by 0 days.

(21) Appl. No.: 11/069,413

(22) Filed: Feb. 28, 2005

(51) Int. Cl.

| | |
|---|---|
| ***B05D 5/02*** | (2006.01) |
| ***B05D 1/32*** | (2006.01) |
| ***B05D 1/38*** | (2006.01) |
| ***B05D 3/00*** | (2006.01) |

(52) U.S. Cl. ..... 427/203; 427/272; 427/282

(58) Field of Classification Search ..... 427/256, 427/180, 202–205, 258, 282

See application file for complete search history.

(56) References Cited

U.S. PATENT DOCUMENTS 3,549,404 A * 12/1970 Lacamera et al. ..... 428/423.3

OTHER PUBLICATIONS

Gaughen, C.D., "Guidance Development: Thin Film Epoxy Mortar (Flooring Systems)," Naval Facilities Engineering Service Center Special Publication SP-2092-SHR, Aug. 2000.*

Gaughen, C.D., "Floor Coating Demonstration: Aircraft Maintenance Shop," Naval Facilities Engineering Service Center publication SSR-2512-SHR, Sep. 1999.*

* cited by examiner

*Primary Examiner*—William Phillip Fletcher, III
(74) *Attorney, Agent, or Firm*—Kajane McManus

(57) ABSTRACT

The method of installing a seamless epoxy coating onto floors, walls and ceilings incorporates a plurality of applications of various layers of coating, drying the applied layers between applications, and if desired, can incorporate addition of an antimicrobial to one or more coats applied to walls, ceilings and floors.

8 Claims, 1 Drawing Sheet

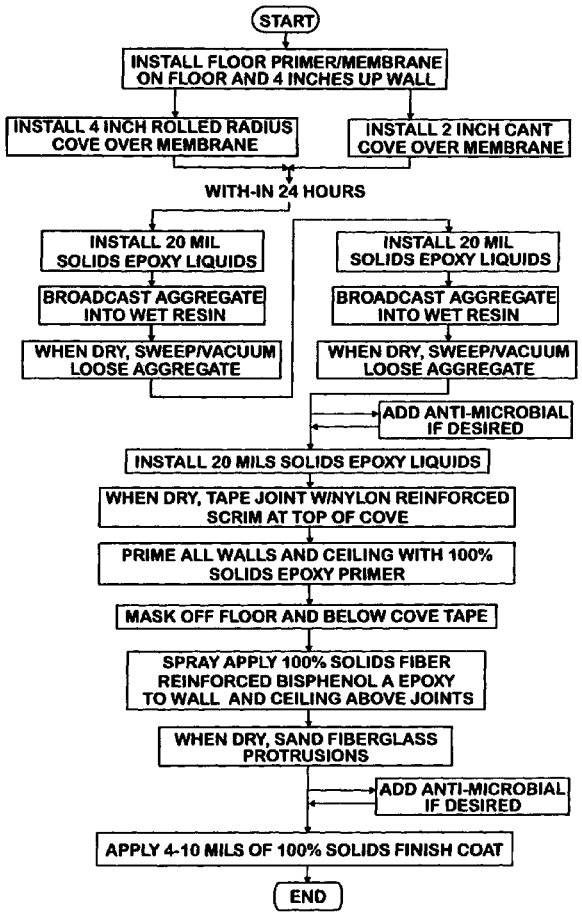

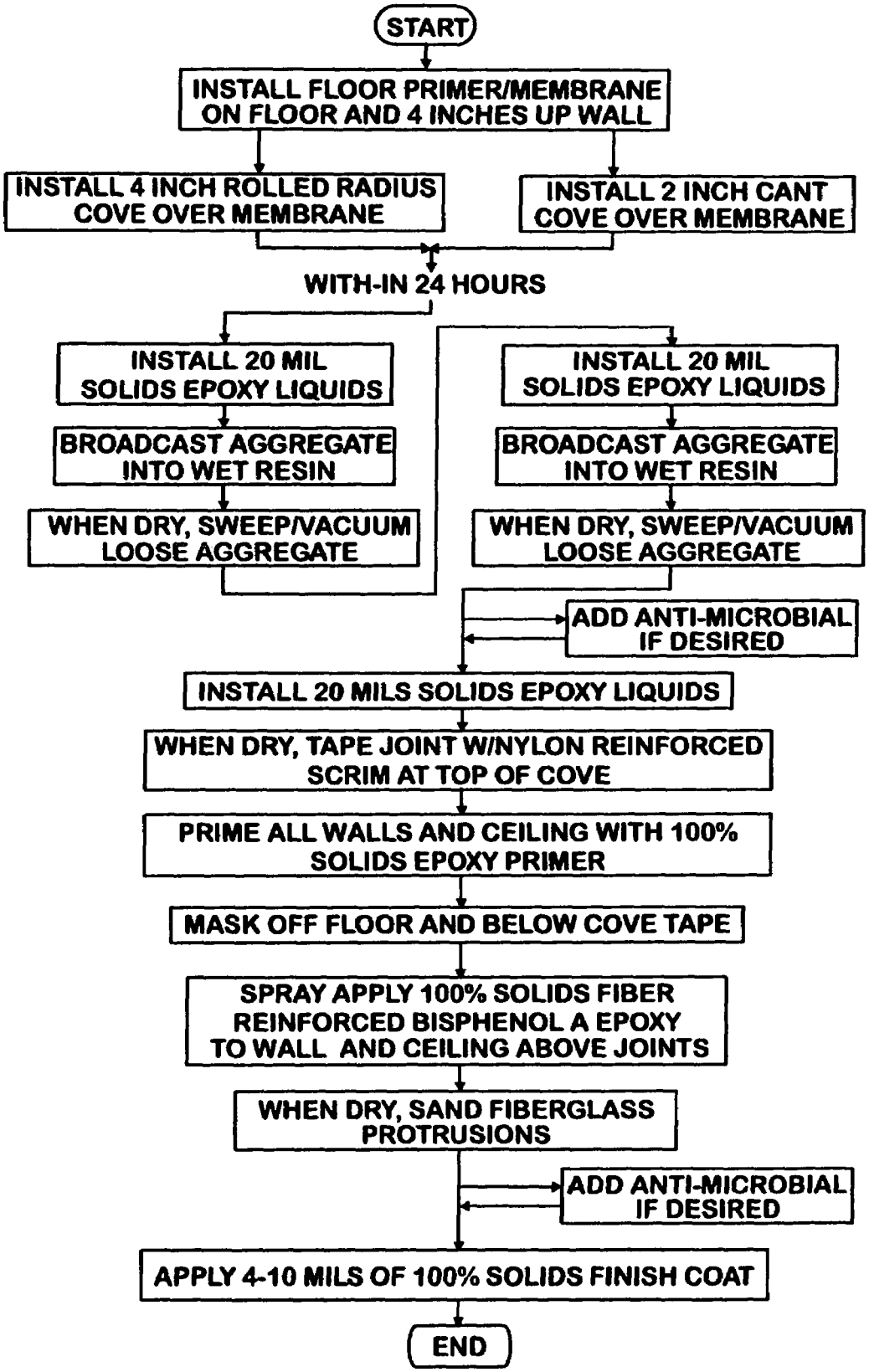
START
INSTALL FLOOR PRIMER/MEMBRANE ON FLOOR AND 4 INCHES UP WALL
INSTALL 4 INCH ROLLED RADIUS COVE OVER MEMBRANE
INSTALL 2 INCH CANT COVE OVER MEMBRANE
WITH-IN 24 HOURS
INSTALL 20 MIL SOLIDS EPOXY LIQUIDS
BROADCAST AGGREGATE INTO WET RESIN
WHEN DRY, SWEEP/VACUUM LOOSE AGGREGATE
INSTALL 20 MIL SOLIDS EPOXY LIQUIDS
BROADCAST AGGREGATE INTO WET RESIN
WHEN DRY, SWEEP/VACUUM LOOSE AGGREGATE
ADD ANTI-MICROBIAL IF DESIRED
INSTALL 20 MILS SOLIDS EPOXY LIQUIDS
WHEN DRY, TAPE JOINT W/NYLON REINFORCED SCRIM AT TOP OF COVE
PRIME ALL WALLS AND CEILING WITH 100% SOLIDS EPOXY PRIMER
MASK OFF FLOOR AND BELOW COVE TAPE
SPRAY APPLY 100% SOLIDS FIBER REINFORCED BISPHENOL A EPOXY TO WALL AND CEILING ABOVE JOINTS
WHEN DRY, SAND FIBERGLASS PROTRUSIONS
ADD ANTI-MICROBIAL IF DESIRED
APPLY 4-10 MILS OF 100% SOLIDS FINISH COAT
END

SEAMLESS EPOXY COATING INSTALLATION METHOD

BACKGROUND OF THE INVENTION

1. Field of the Invention

The present invention relates to a method of installing seamless epoxy wall, ceiling and floor coatings.

2. Prior Art

Heretofore various methods of installing a seamless epoxy coating on floors, walls and ceilings have been proposed.

However, none have been as simple as that disclosed herein, or provided a watertight, strong, durable coating, to which an antimicrobial can be added, if desired.

SUMMARY OF THE INVENTION

According to the invention there is provided a method of installing a seamless epoxy coating onto floors, walls and ceilings incorporates a plurality of applications of various layers of coating, drying the applied layers between applications, and if desired, can incorporate addition of an antimicrobial to one or more coats applied to walls, ceilings and floors.

BRIEF DESCRIPTION OF THE DRAWINGS

The drawing diagrams the steps of the method.

DESCRIPTION OF THE PREFERRED EMBODIMENTS

The method of the present invention comprises the steps as follows:

1. Install the floor primer/membrane on to the floor and up the adjoining walls 4 inches.
2. Install 4" rolled radius or 2" cant cove over the membrane material within a 24 hour time frame after the primer/membrane was installed.
3. Install 20 mils of 100% solids epoxy liquids and broadcast aggregate into the wet resin until it will accept no more.
4. After the epoxy and sand is dry (normally 2 to 24 hours) sweep up or vacuum up the loose aggregate that did not stick into the wet resin and repeat step #3.
5. After the epoxy and sand is dry (normally 2 to 24 hours) sweep up or vacuum up the loose aggregate that did not stick into the wet resin and again install 20 mils of 100% solids epoxy liquids over the sand finish but do not broadcast aggregate into the wet liquids this time.
6. After the epoxy dry (normally 2 to 24 hours) tape the joint with a nylon reinforced skrim at the top of the cove (either rolled radius or cant cove) allowing at least ¼" above and below the joint.
7. Prime all wall and ceiling area with 100% solids epoxy primer.
8. Mask off the finished floor and the cove below the area where the tape has been installed.
9. Spray apply 100% solids fiber reinforced bisphenol A epoxy to the walls and ceilings above the joints.

10. After the epoxy is dry (normally 2 to 24 hours) sand down the fiberglass protrusions and apply 4–10 mils of 100% solids bisphenol A finish coat.

If desired, the step of adding a antimicrobial to the finish coat prior to application thereof can be incorporated into the method.

As described above the method provides a number of advantages some which have been described above and other of which are inherent in the invention. Also, modifications can be proposed to the method without departing from the teachings herein. Accordingly, the scope of the invention is only to be limited as necessitated by the accompanying claims.

The invention claimed is:

1. Method of installing seamless epoxy wall, ceiling and floor coatings comprising the steps of:

install a floor primer/membrane material onto a floor and up adjoining walls;

install a cove over the primer/membrane material within a 24 hour time frame after primer/membrane material installation;

install a first coat of 20 mils of 100% solids epoxy liquids and broadcast aggregate onto the cove surface until saturated;

after the first coat of broadcast aggregate is dry remove loose aggregate;

install a second coat of 20 mils of 100% solids epoxy liquids and broadcast aggregate onto the cove surface until saturated; after the second coat of broadcast aggregate is dry again remove loose broadcast aggregate and again install 20 mils of 100% solids epoxy liquids over the broadcast aggregate;

after drying, tape joint at the top of the cove with a scrim;

prime all wall areas above the joint and the ceiling areas with 100% solids epoxy primer;

mask off the finished floor and the cove below the top joint area;

spray 100% solids fiber reinforced bisphenol A epoxy onto areas above the tape joint;

after drying of the bishenol A epoxy, sand down any solids protrusions and apply 4–10 mils of 100% solids bisphenol A finish coat.

2. The method of claim 1 wherein the primer/membrane material is elevated up the walls approximately 4".

3. The method of claim 1 wherein a 41" rolled radius cove is installed.

4. The method of claim 1 wherein a 2" cant cove is installed.

5. The method of claim 1 wherein all drying steps take 2–24 hours between coats.

6. The method of claim 1 wherein the scrim is nylon reinforced.

7. The method of claim 1 wherein tape extends at least ¼" above and below the joint.

8. The method of claim 1 further including the step of incorporating an antimicrobial at least into the finish coat.

* * * * *